US007614543B1

(12) United States Patent
Miller

(10) Patent No.: US 7,614,543 B1
(45) Date of Patent: Nov. 10, 2009

(54) CARTON WITH GRAVITY FEED DISPENSER

(75) Inventor: Charles A. Miller, Williamsburg, OH (US)

(73) Assignee: The C. W. Zumbiel Company, Cincinnati, OH (US)

( * ) Notice: Subject to any disclaimer, the term of this patent is extended or adjusted under 35 U.S.C. 154(b) by 527 days.

(21) Appl. No.: 11/295,267

(22) Filed: Dec. 6, 2005

Related U.S. Application Data

(60) Provisional application No. 60/641,997, filed on Jan. 7, 2005, provisional application No. 60/678,088, filed on May 5, 2005.

(51) Int. Cl.
*B65D 5/00* (2006.01)

(52) U.S. Cl. ..... 229/122.1; 206/45.2; 206/755

(58) Field of Classification Search ..... 229/122.1, 229/87.12, 87.14, 104; 221/67, 302; 206/45.2, 206/751, 752, 755
See application file for complete search history.

(56) References Cited

U.S. PATENT DOCUMENTS 1,497,536 A * 6/1924 Billstein ..... 206/45.21
2,294,965 A * 9/1942 Davidson ..... 206/45.21
2,473,635 A * 6/1949 Buttery ..... 206/45.26
3,178,242 A 4/1965 Ellis et al.
5,289,943 A 3/1994 Powell
5,878,947 A 3/1999 Hoy et al.
6,866,185 B2 3/2005 Harrelson
6,902,104 B2 6/2005 Holley, Jr. et al.
2004/0060972 A1* 4/2004 Harrelson ..... 229/104
2004/0188508 A1* 9/2004 Holley ..... 229/242
2005/0178687 A1* 8/2005 Spivey, Sr. ..... 206/427

FOREIGN PATENT DOCUMENTS

GB 2189223 A * 10/1987

* cited by examiner

*Primary Examiner*—Nathan J Newhouse
*Assistant Examiner*—Christopher Demeree
(74) *Attorney, Agent, or Firm*—Wood, Herron & Evans, LLP

(57) ABSTRACT

A package includes an article group formed of cylindrical articles disposed on their sides in a side-by-side parallel fashion, and a carton disposed around the group. The carton includes a top wall, opposed side walls, end walls and an article dispenser. The side walls are disposed alongside the ends of the articles while one end wall is disposed adjacent to the side wall of an endmost article. The dispenser is formed from the end and top walls and includes at least one retaining panel to hold all the articles in the carton until removed by the user. Removal of the articles is assisted by a gravity feed stand included in the carton which when implemented promotes the gravity feed of the articles toward the dispenser for convenient access and removal from the carton by a user.

26 Claims, 6 Drawing Sheets

CARTON WITH GRAVITY FEED DISPENSER

This claims the benefit of U.S. Provisional Patent Application Ser. Nos. 60/641,997, filed Jan. 7, 2005, and 60/678,088, filed May 5, 2005, each of which is hereby incorporated by reference in its entirety.

BACKGROUND OF THE INVENTION

The invention relates to cartons, and more particularly, to a carton for multiple articles such as beverage cans in which the carton has a dispenser for controlled removal of individual articles.

Cartons for encasing multiple articles are useful for enabling consumers to obtain and transport a desired quantity of individual articles such as soft drinks or other beverages. A consumer frequently desires to remove one article at a time from the multiple-pack carton. Thus, a carton with a dispenser that facilitates the removal of a single article from the carton at a time is desirable.

When the articles contained in the carton are cylindrical, and are disposed in the carton upon their sides (i.e., with the longitudinal axis of the cylinder being generally horizontal), it is important that the articles be constrained such that the remaining articles do not roll out of the dispenser when one article is removed. Another important feature is that the dispenser provides easy access to the articles. Additionally, when removing individual articles from such a carton, the user should be able to easily determine how many articles remain in the carton. Thus, a carton with a dispenser that constrains remaining articles so that they do not undesirably roll from or otherwise exit the carton when one article is removed is also desirable.

Cartons and dispensers which are aimed at satisfying at least some of these objectives are disclosed in the present inventor's U.S. patent application Ser. No. 10/680,364 published on May 13, 2004 under Publication No. US 2004-0089671, as well as U.S. Pat. No. 6,578,736; U.S. Patent Application Publication Nos. US 2002/0070139; US 2002/0088820; and US 2002/0088821, each of which is hereby incorporated by reference. Nevertheless, the cartons and associated dispensers disclosed in each of those patent applications each lack one feature. Namely, the ability to automatically and conveniently position the cans or articles in the carton proximate the dispenser for easy access by a user. While the initial cans are easily removed from the carton once the dispenser is opened, after those cans are removed, the remaining cans have a tendency to position themselves and remain in the lowermost tier and/or near the back end of the carton and away from the dispenser.

The prior art includes various cartons and/or mechanisms to elevate the end of the carton opposite from the dispenser to promote the gravity feed of the cans remaining in the carton toward the dispenser. Examples are shown in U.S. Pat. Nos. 3,178,242; 5,289,943; and 5,878,947, each of which is hereby incorporated by reference entirely.

Nevertheless, such mechanisms are ineffective, difficult and inconvenient for a user to implement, too expensive to manufacture and/or impractical to utilize with current carton and dispenser designs.

SUMMARY OF THE INVENTION

These and other drawbacks in the prior art have been addressed and overcome with a carton, dispenser and gravity feed device of this invention. A carton of this invention has a dispenser for articles which in one embodiment exposes the upper corner of the carton to reveal an endmost article for removal. The carton also includes a gravity feed feature which is convenient and easy for the user to implement, economical to make and effective to promote the advance of the cans toward the dispenser.

In various embodiments of this invention, the carton includes serially and foldably connected bottom, side, top and side panels. Each of these panels also includes end flaps projecting from each end of the panel. An out board edge of one of the side panels includes a glue flap for joinder to the bottom panel. The corresponding end flaps on one end of the carton are folded and glued together to close the carton. The corresponding end flaps on the opposite end of the carton are folded together and include a dispenser according various embodiments compatible with this invention.

One such dispenser includes a pair of slanted tear lines in the bottom end flap. A finger hole is formed at the juncture of the bottom panel, bottom end flap and slanted tear lines to commence opening the carton and dispenser. Each side end flap at the dispensing end of the carton includes a tear line which angularly projects from the side edge of the side end flap adjacent to the bottom end flap toward the fold line joining the side end flap to the side panel. The tear line then extends along the fold line joining the side end flap with the side panel to the intersection of the top panel and top end flap. The tear line then progresses along the juncture between the top panel and the side panel toward the handle formed in the top panel of the carton. The tear lines along the common edges of the top panel and each adjacent side panel extend at an angle into the top panel and terminate at a cut crease score or fold line which extends laterally across the top panel. The tear line forming the dispenser of this embodiment does not extend through either side panel or the top panel of the carton. The crease line across the top panel joining the corresponding tear lines is a fold line as opposed to an extension of the tear lines.

Once the carton is erected and filled, the user opens the dispenser by inserting a finger into the hole in the bottom panel adjacent the bottom end flap and pulling a middle portion of the bottom end flap and the center portions of the side end flaps upwardly tearing along the tear line through the bottom end flap and side end flaps. As the user continues to pull upwardly, the dispenser is torn along the tear lines adjacent the side panels and the top panel to the fold line in the top panel. In one variation of this embodiment, the top end flap is glued to the center portions of the side end flaps so that the entire dispensing structure is folded backwardly onto the top panel and a tongue flap formed from the center portion of the bottom end flap and the side end flaps is inserted into the handle opening in the top panel to securely and releasably retain the dispenser.

The cans do not fall from the carton once the dispenser is opened because a remaining portion of the side end flaps adjacent the side panel remain intact at the end of the carton to form retaining panels and hold the cans therein.

According to embodiments of this invention, once the user opens the dispenser, the initial can, typically the forward uppermost can, may be removed from the carton. Once the first can is removed from the carton, the user may easily and conveniently erect the gravity feed stand according to this invention. Advantageously, the gravity feed stand according to embodiments of this invention is easily accessed by the user by initially tearing the gravity feed stand beginning in the top panel of the carton at the end of the carton opposite from the dispenser. Access to initiate the gravity feed stand according to this invention on the top panel of the carton is significantly more convenient and user-friendly than prior gravity feed stands which were located primarily on the bottom of the carton. The requirement of initially accessing the gravity feed stand on the bottom of the carton is a significant disadvantage especially after the dispenser is opened in that the cans and articles in the carton have a tendency to fall out of the carton while the user is manipulating the carton to erect the gravity feed stands of the prior art.

The gravity feed stand of this invention is formed in part by a tear line extending through the top panel and adjacent portions of the adjoining side panels of the carton. The gravity feed stand tear line extends into the end of the carton formed by the side panel end flaps. A pair of generally parallel fold lines extend through the end panel so that the end panel may be folded downwardly onto itself and the stand located on the bottom of the carton thereby elevating the end of the carton opposite from the dispenser and promoting the gravity feed of the cans towards the dispensing end of the carton.

According to the carton, blank package and associated method for dispensing the packaged articles, this invention provides for a convenient and user friendly implementation of the dispenser, gravity feed stand and associated carton or package without the uncontrolled and/or inadvertent removal of the upper forward most article during the removal of the displaceable portion of the carton. Moreover, the dispenser does not require the removal of significant portions of the carton and can be re-closed if desired. The gravity feed stand is also easily and conveniently implemented to enhance access to the cans in the carton via the dispenser.

Other advantages and benefits of this invention will be apparent from the following description, the accompanying drawings, and the appended claims.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
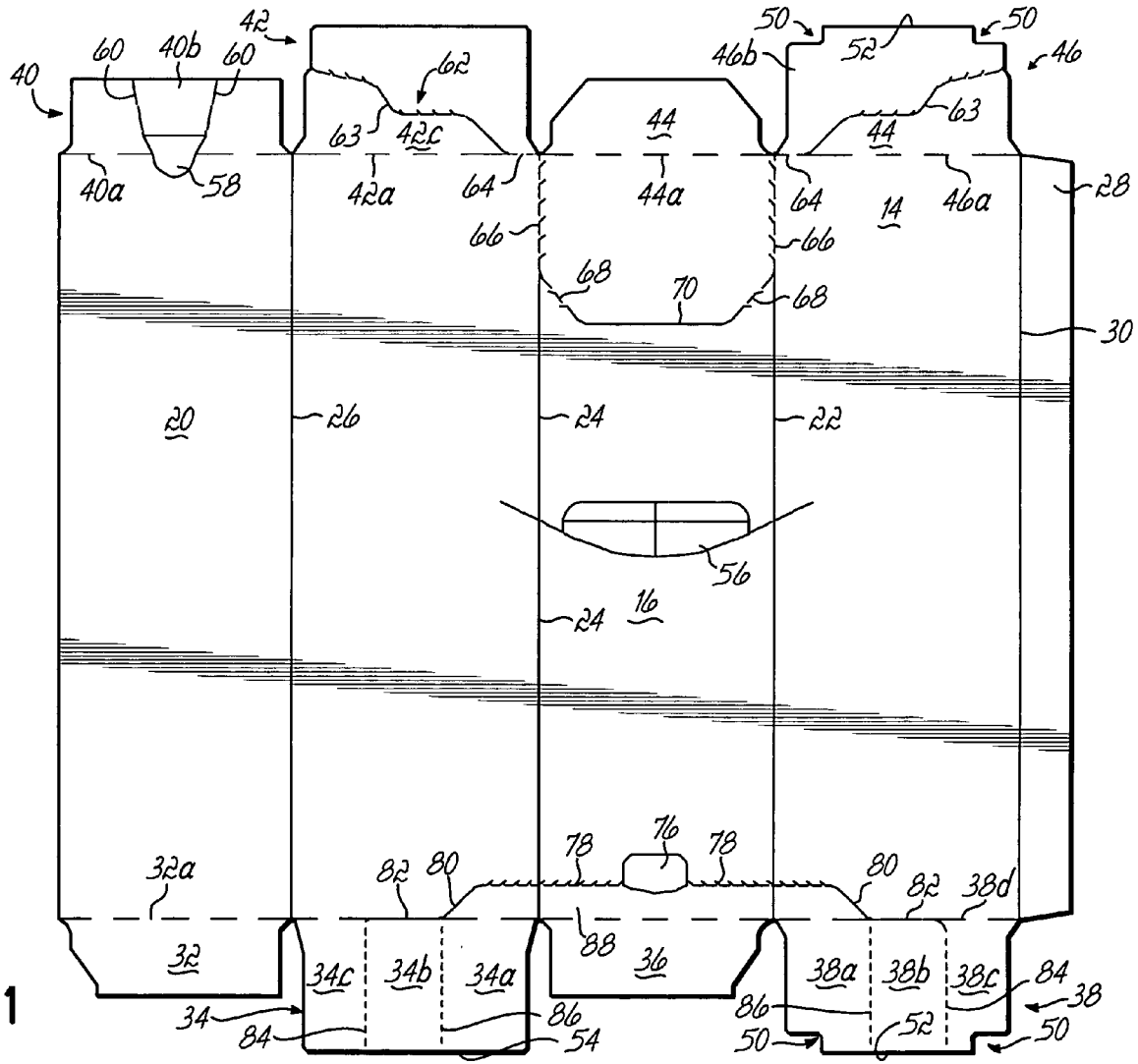
FIG. 1 is a plan view of a blank for forming a carton with a dispenser and a gravity feed stand according to one embodiment of this invention.

FIGS. 1 to 3B illustrate one embodiment of this invention, and throughout these drawings, the same or similar reference numerals are used to denote the same or similar features of the invention.

FIGS. 2A to 3B illustrate a carton 10 having a dispenser and a gravity feed stand in accordance with this invention. FIG. 1 illustrates a blank 12 from which the carton 10 of FIGS. 2A-3B is formed. Cans may be arranged in a 2×6 array in the carton 10. More specifically, the cans are arranged in a group consisting of two vertically disposed and aligned tiers each including six 12 ounce cans. However, this invention is not limited to a 2×6 arrangement and is readily used in a 2×c, 3×4, 4×3, other arrangement and/or other size cans. The cans in each tier are disposed on their sides in a side-by-side parallel fashion with their respective longitudinal axes generally horizontal when the carton is supported on a shelf, table or the like.

Figure 2A:
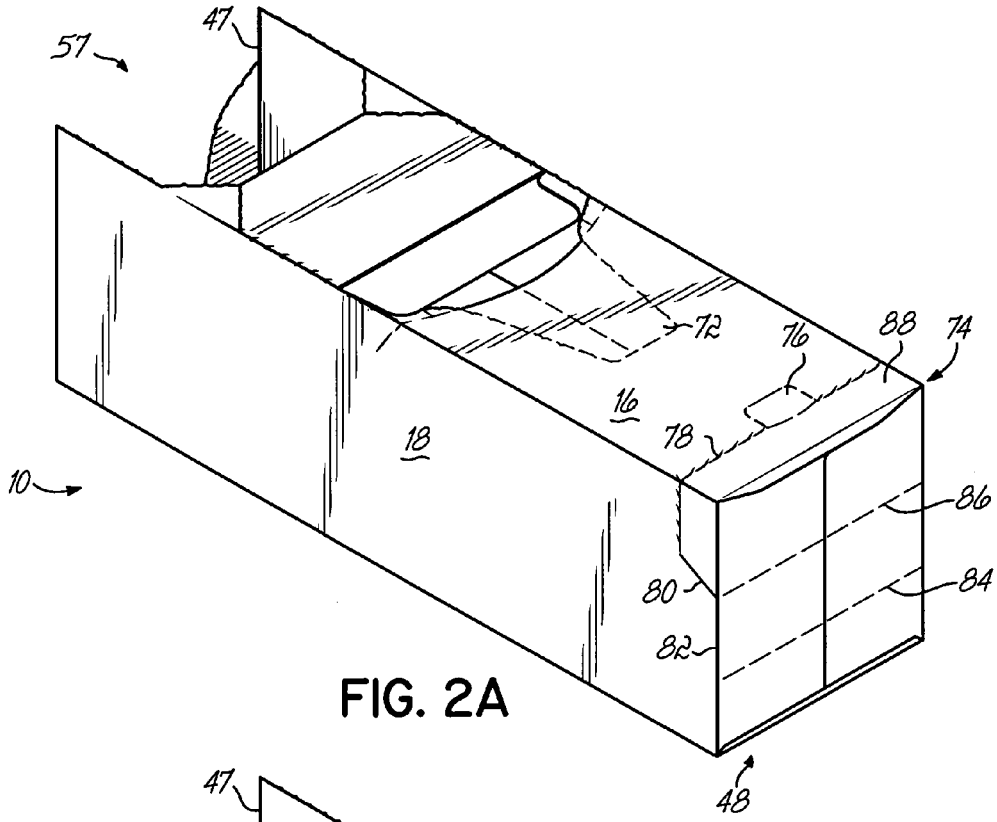
FIG. 2A is a perspective view of a carton constructed from the blank of FIG. 1 with the dispenser open to provide access to the articles in the carton.

Referring to FIG. 1, one embodiment of the blank 12 includes four primary panels for forming the carton walls, i.e., a first side wall panel 14, a top wall panel 16, a second side wall panel 18 and a bottom wall panel 20 foldably connected one to the next along fold lines 22, 24 and 26. A glue flap 28 is foldably connected to side panel 14 along fold line 30. In alternative embodiments, the carton blank may be formed into a carton with composite wall panels, thereby avoiding the need for glue flap 28. Reference numerals 32, 34, 36, 38, 40, 42, 44 and 46 designate end flaps foldably connected the ends of the panels 14, 16, 18 and 20, respectively. Each end flap 32, 34, 36, 38, 40, 42, 44, 46 is joined to the associated panel 14, 16, 18, 20 by a fold line 32*a*, 34*a*, 36*a*, 38*a*, 40*a*, 42*a*, 44*a*, 46*a*, respectively. The end flaps 32, 34, 36 and 38 arranged along the lower edge (as viewed in FIG. 1) of the blank 12 form a composite end wall 48 (FIG. 2A). The end flaps 40, 42, 44 and 46 arranged along the upper edge of FIG. 1 form a composite end wall (not shown).

To form an erected carton from the blank 12, the side wall panels 14, 18 are folded along the fold lines 22, 24. The bottom wall panel 20 is folded along the fold line 26 until it overlaps the glue flap 28 folded inwardly along fold line 30. The overlapping portions of the glue flap 28 and the bottom panel 20 are glued to each other to thereby form a flat tubular carton. The flat tubular carton is then expanded into an open-ended tubular form. After cans are loaded through one or both of the open ends of the carton 10, the end flaps 32, 34, 36, 38, 40, 42, 44 and 46 are folded to form the respective end walls to thereby close the ends of the carton 10. To form the end walls, the top and bottom end flaps 34, 38, 42 and 46 are folded to their respective positions generally perpendicular to the associated panel wall. The end flaps 36, 44 are then folded to their respective vertical positions to overlap the top and bottom end flaps 34, 42, 38 and 46. End flaps 38, 46 each include a pair of notches 50 so that the terminal edge 52 of each flap 38, 46 is shorter than the corresponding edge 54 on the end flaps 34, 42. Glue is applied to the outside faces of the end flaps 34, 36, 38, 42, 44 and 46. The end flaps 32, 40 are then folded onto the top, bottom, and side end flaps. This causes the side end flaps 34 and 42 to be glued atop the other end flaps.

A handle 56 is also included in the top wall 16. While any appropriate handle or orientation for the handle can be used with the carton 10, preferably handle 56 is constructed according to U.S. Pat. No. 5,106,014, which is hereby incorporated by reference.

A dispenser 54 according to one embodiment of the invention is formed in part by the corresponding end flaps 40, 42, 44, 46 on the dispensing end 47 of the carton 10. A finger hole 58 is formed at the juncture of the bottom panel 20, bottom end flap 40 and a pair of slanted tear lines 60 in the bottom end flap 40 to commence opening the carton 10 and dispenser. The slanted tear lines 60 are useful for a carton containing an arrangement of two tiers of six cans of twelve ounces each; however, the tear lines 60 may be of a different orientation, inclination or configuration for cartons designed to carry other sized cans or arrangements of cans. For example, the tear lines are generally parallel for a carton containing twelve ounce cans in a 2×6 configuration. Each side end flap 42, 46 at the dispensing end 47 of the carton 10 includes a tear line 62 which angularly projects from the side edge of the side end flap 42, 46 adjacent to the bottom end flap 40 toward the fold line 42*a*, 46*a* joining the side end flap 42, 46 to the associated side panel 18, 14. The tear line 62 may include a jog 63. A tear line 64 then extends along the fold line 42*a*, 46*a* to the intersection of the top panel 16 and top end flap 44. A tear line 66 then progresses along the juncture between and/or the fold lines 22, 24 joining the top panel 16 and the side panel 14, 18 toward the handle 56 formed in the top panel 16 of the carton 10. The tear lines 66 along the fold lines 22, 24 each terminate at an angular tear line 68 in the top panel 16. Each angular tear line 68 terminates at a cut crease score or fold line 70 which extends laterally across the top panel 16.

The tear line(s) forming the dispenser 57 of this embodiment do/does not extend through either side panel 14, 18 or the top panel 16 of the carton 10. The crease line 70 across the top panel 16 joining the corresponding tear lines is a fold line as opposed to an extension of the angular tear lines 68. One of ordinary skill will understand that the design and configuration of the dispenser 57 shown and described herein is exemplary only and this invention is readily applicable with other dispenser designs.

Once the carton 10 is erected and filled with cans, the user opens the dispenser 57 by inserting a finger into the hole 58 in the bottom panel 20 adjacent the bottom end flap 40 and pulling a middle portion 40*b* of the bottom end flap 40 and portions 42*b*, 46*b* of the side end flaps 42, 46 upwardly tearing along the tear lines 60, 62 through the bottom end flap 40 and side end flaps 42, 46. As the user continues to pull upwardly, the dispenser is torn along the tear lines 64 adjacent the side panels 14, 18 and the angular tear lines 68 to the fold line 70 in the top panel 16. In one variation of this embodiment, the top end flap 44 is glued to the center portions 42*b*, 46*b* of the side end flaps 42, 46 so that the entire dispensing structure is folded backwardly onto the top panel 16 and a tongue flap 72 formed from the center portion 40*b* of the bottom end flap 40 and the portions 42*b*, 46*b* are inserted into the handle opening 56 in the top panel 16 to securely and releasably retain the dispenser. The cans do not fall from the carton 10 once the dispenser is opened because retaining portions 42*c*, 46*c* of the side end flaps 42, 46 adjacent the side panels 14, 18 remain intact at the end 47 of the carton 10 to form retaining panels 42*c*, 46*c* and hold the cans therein.

If needed, the tongue flap 72 can be removed from the handle opening 56 and folded downwardly toward the dispensing end 47 of the carton while remaining attached to the top panel 16 along the fold line 70. The tongue flap 72 can then be tucked between the corresponding retaining panel portions 42*c*, 46*c* of the side end flaps 42, 46 remaining attached to the respective side panel 18, 14 to releasably close the dispenser for transport of the carton 10 if needed.

Advantageously, the side panels 14, 18 remain intact after the dispenser 57 is opened according to this embodiment of the invention. Additionally, the dispenser 57 need not be entirely removed from the carton 10 which can then be releasably closed once again if needed. Moreover, the handle opening 56 provides a convenient hold for the tongue flap 72 during removal of the cans.

The user may implement the gravity feed stand 74 to elevate or prop up the end 48 of the carton 10 opposite the dispensing end 47 and thereby providing a gravity feed inclination for the remaining cans in the carton 10 to roll towards the dispensing end 47 for convenient access and removal through the dispenser 57 by a user. This may be done before or after the dispenser 57 is opened and one or more cans removed from the carton 10. Advantageously, the gravity feed stand 74 is initially erected by tearing the end 48 of the carton 10 in the top panel 16. As a result, the carton 10 with the dispenser 57 open may remain in an upright position while the stand 74 is erected thereby avoiding the problems of flipping the carton 10 to gain access to a feature on the bottom of the carton 10 used to elevate the carton 10 for gravity feed dispensing.

The gravity feed stand 74 includes in one embodiment a finger flap 76 located in the top panel 16 of the carton adjacent the end 48 opposite the dispensing end 47. The user inserts one or more fingers in the finger flap 76 and pulls toward the end 48 and away from the dispenser 57 thereby tearing the top panel 16 along a tear line 78 in opposite directions outwardly from the finger flap 76 toward the adjacent side panels 14, 18. The tear line 78 in the top panel 16 extends beyond the fold lines 22, 24 joining the side panels 14, 18 to the top panel 16. The tear line 78 is generally linear as it extends into the respective side panels 14, 18. In the side panels 14, 18, the tear line 78 includes an angular tear portion 82 which merges the tear line 78 with the junctures 34*a*, 38*d* between the side panels 14, 18 and the associated side end panels 34, 38. The tear line 78 then progresses via portion 82 along the fold lines 34*a*, 38*a* until it terminates at a fold line 84 extending transversely across the side end panels, 34, 38. The fold line 84 is formed in the side end panels 34, 38 and is generally parallel to and spaced from a fold line 86 on the side end panels 34, 38 which originates at the juncture of the angular tear line portion 80 and the fold lines 34*a*, 38*a*. The fold lines 84, 86 separate the side end panels into upper 34*a*, 38*a* intermediate 34*b*, 38*b* and lower 34*c*, 38*c* regions of the end panel 48. The tear line 78 in the top panel 16 and portions of the side panels 14, 18 adjacent the end panel 48 defines a base 88 of the stand 74 that remains attached to the end panel 48 in a generally U-shaped cross-sectional configuration of the gravity feed stand 14 as will be described later herein.

Figure 2B:
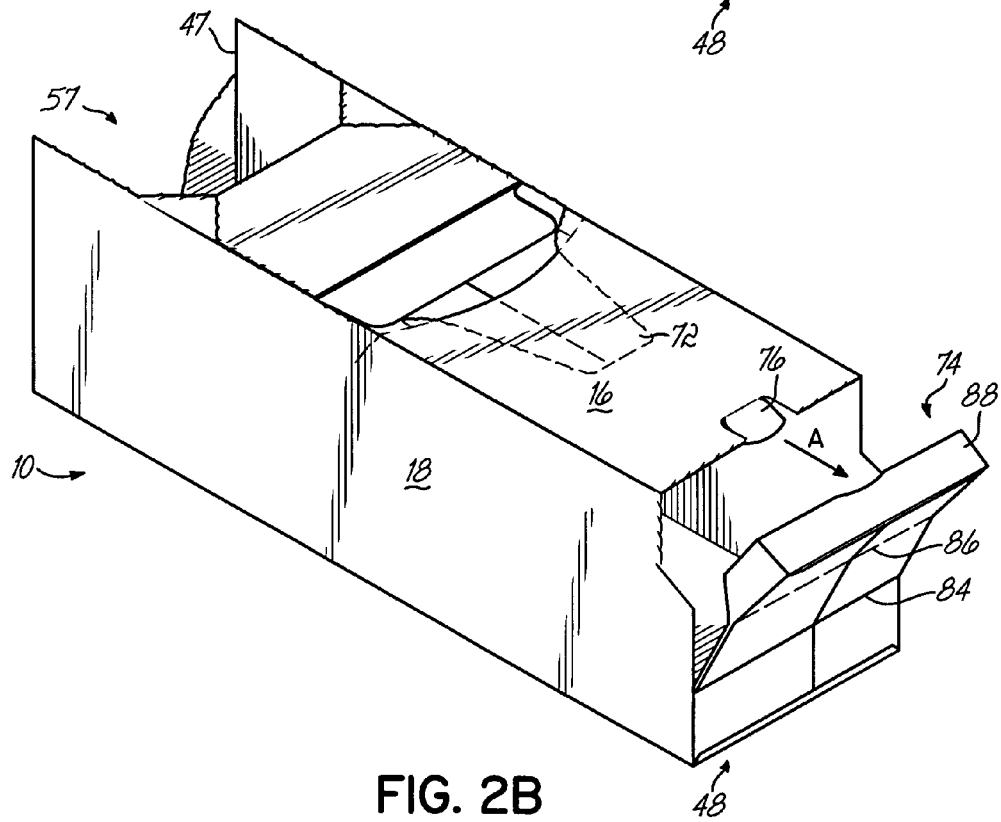
FIGS. 2B-2C are sequential views similar to FIG. 2A of the gravity feed stand being erected.
Figure 2C:
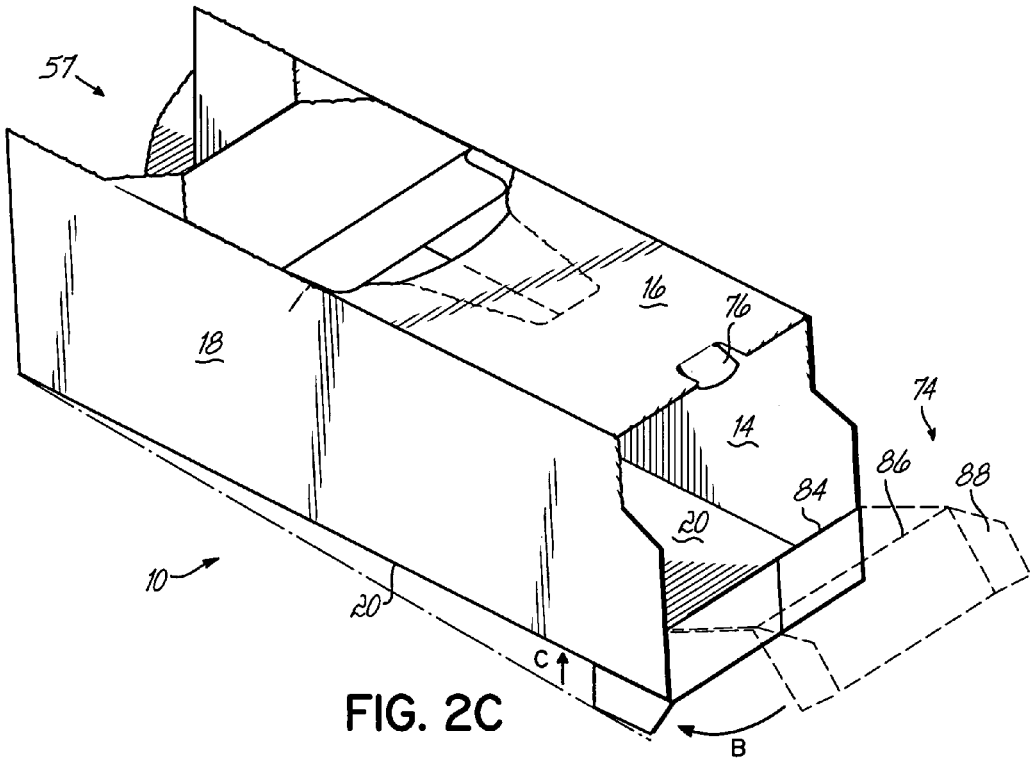
Figure 3A:
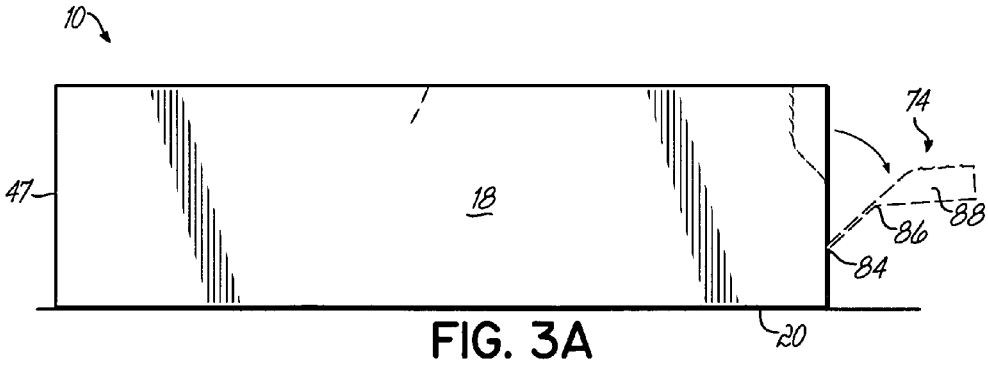
FIG. 3A is a side elevational view of the carton prior to and during the gravity feed stand being erected.
Figure 3B:
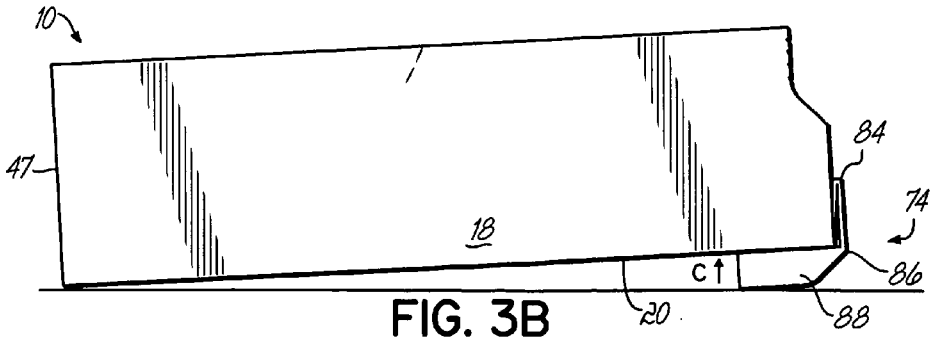
FIG. 3B is a side elevational view of an end of the carton being elevated with the gravity feed stand according to one embodiment of this invention.

As shown in FIG. 2B, the initial separation of the gravity feed stand 74 from the remainder of the carton 10 begins by tearing along the tear line 78 and pulling the base 88 and portions 34*a*, 38*a*, 38*b*, 34*b* outwardly from the carton 10 in the direction of arrow A. The gravity feed stand 74 is then pivoted around the fold line 84 in the direction of arrow B of FIG. 2C until the panels 34*b*, 38*b* are folded into face-to-face juxtaposition with the panels 34*c*, 38*c* as shown generally in FIG. 3B. At this point, the panels 34*a*, 38*a* are juxtaposed to the bottom panel 20 and the base 88 of the gravity feed stand 74 props up the end 48 of the carton 10 (arrow C in FIG. 3B). In one embodiment, the portions 34*c*, 38*c* and 34*b*, 38*b* are equal height thereby providing a retaining end wall 38*c*, 34*c* to prevent the cans from rolling out the end 48 of the carton 10 irrespective of the gravity feed inclination provided by the stand 74.

Figure 4:
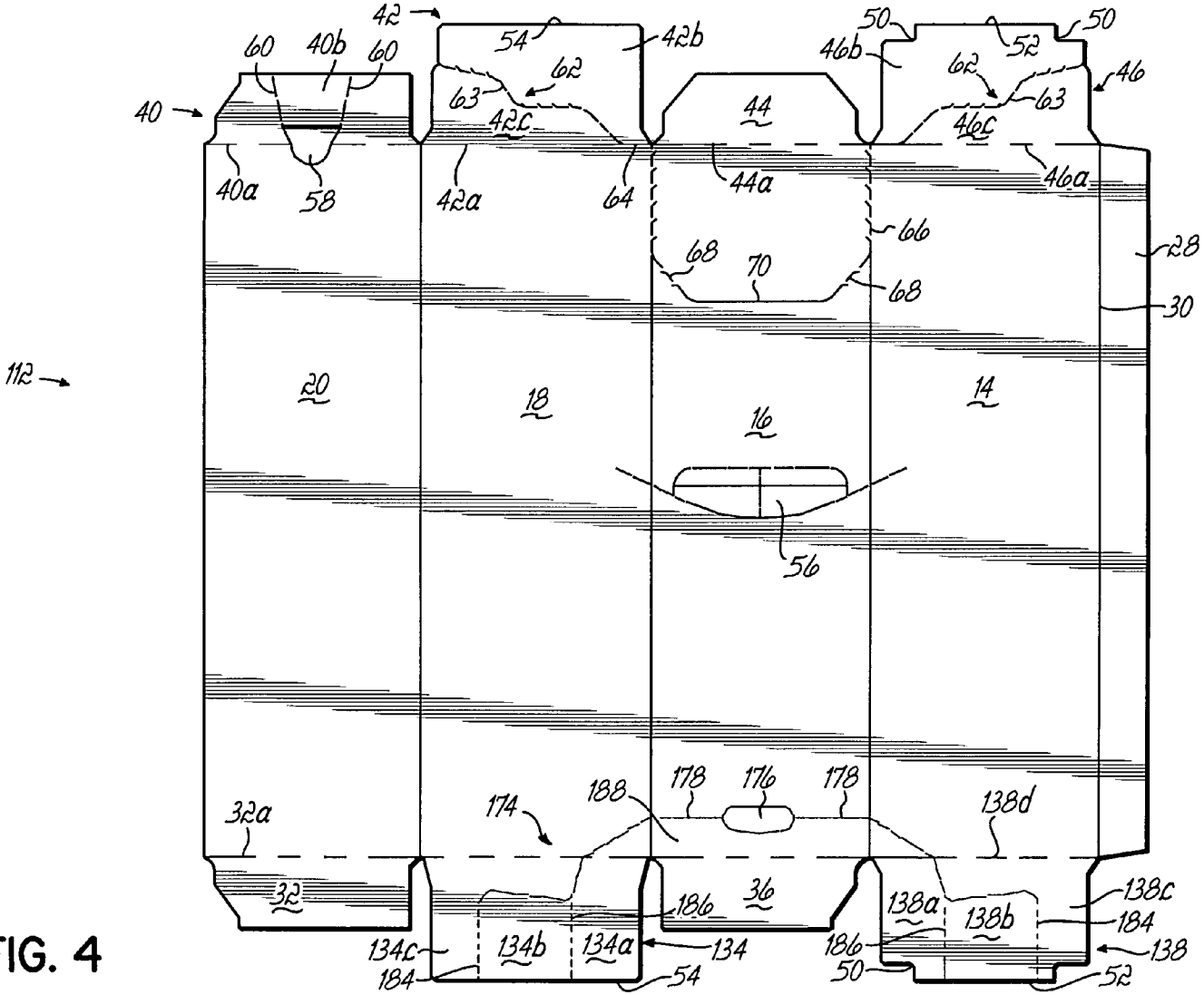
FIG. 4 is a plan view of a blank for forming a carton with a dispenser and a gravity feed stand according to another embodiment of this invention.

Another embodiment of this invention is shown in FIGS. 4-6B with the carton blank 112 being shown in FIG. 4 adapted to form a carton 110. Similar reference numerals will be used in describing features of this embodiment of the invention which are the same or similar to the embodiment of the invention shown in FIGS. 1-3B.

Figure 5A:
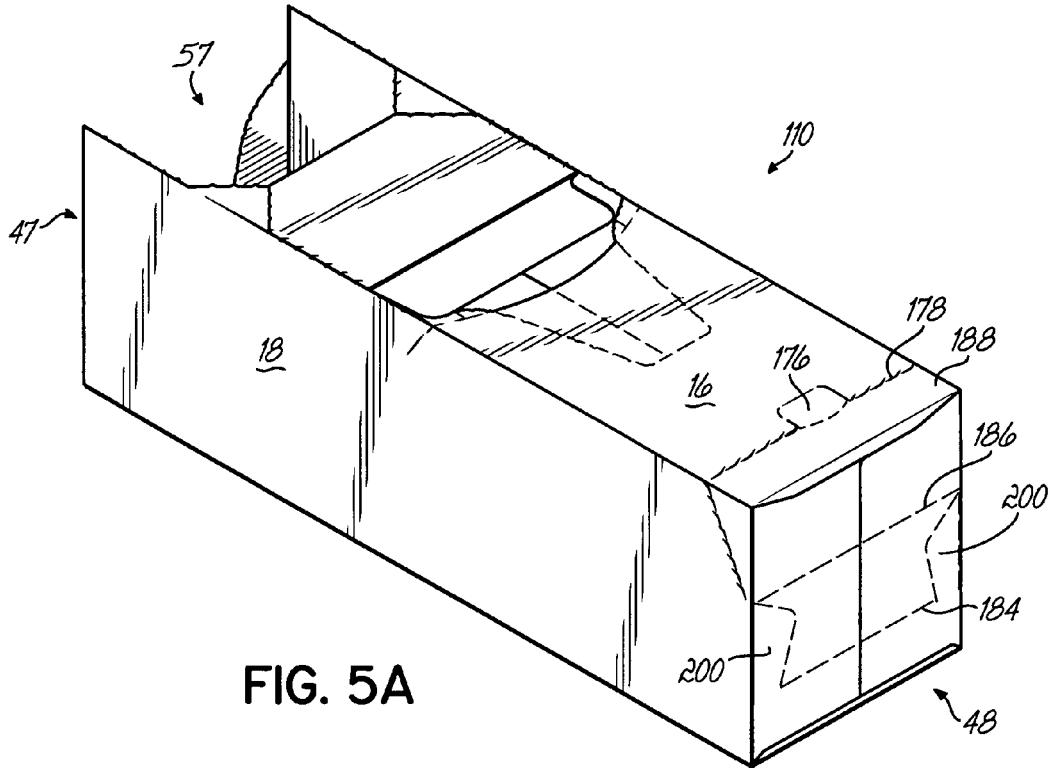
FIG. 5A is a perspective view of a carton constructed from the blank of FIG. 4 with the dispenser open to provide access to the articles in the carton.

Referring to FIG. 4, the blank 112 includes four primary panels for forming the carton walls, i.e., a first side wall panel 14, a top wall panel 16, a second side wall panel 18 and a bottom wall panel 20 foldably connected one to the next along fold lines 22, 24 and 26. A glue flap 28 is foldably connected to side panel 14 along fold line 30. Reference numerals 32, 134, 36, 138, 40, 42, 44 and 46 designate end flaps foldably connected the ends of the panels 14, 16, 18 and 20, respectively. Each end flap 32, 134, 36, 138, 40, 42, 44, 46 is joined to the associated panel 14, 16, 18, 20 by a fold line 32*a*, 34*a*, 36*a*, 38*a*, 40*a*, 42*a*, 44*a*, 46*a*, respectively. The end flaps 32, 134, 36 and 138 arranged along the lower edge (as viewed in FIG. 4) of the blank 112 form a composite end wall 48 (FIG. 5A). The end flaps 40, 42, 44 and 46 arranged along the upper edge of FIG. 4 form a composite end wall (not shown).

To form an erected carton from the blank 112, the side wall panels 14, 18 are folded along the fold lines 22, 24. The bottom wall panel 20 is folded along the fold line 26 until it overlaps the glue flap 28 folded inwardly along fold line 30. The overlapping portions of the glue flap 28 and the bottom panel 20 are glued to each other to thereby form a fiat tubular carton. The flat tubular carton is then expanded into an open-ended tubular form. After cans are loaded through one or both of the open ends of the carton 110, the end flaps 32, 134, 36, 138, 40, 42, 44 and 46 are folded to form the respective end walls to thereby close the ends of the carton 110. To form the end walls, the top and bottom end flaps 134, 138, 42 and 46 are folded to their respective positions generally perpendicular to the associated panel wall. The end flaps 36, 44 are then folded to their respective vertical positions to overlap the top and bottom end flaps 134, 42, 138 and 46. End flaps 138, 46 each include a pair of notches 50 so that the terminal edge 52 of each flap 138, 46 is shorter than the corresponding edge 54 on the end flaps 134, 42. Glue is applied to the outside faces of the end flaps 134, 36, 138, 42, 44 and 46. The end flaps 32, 40 are then folded onto the top, bottom, and side end flaps. This causes the side end flaps 134 and 42 to be glued atop the other end flaps.

A handle 56 is also included in the top wall 16. While any appropriate handle or orientation for the handle can be used with the carton 110, preferably handle 56 is constructed according to U.S. Pat. No. 5,106,014, which is hereby incorporated by reference.

A dispenser 54 according to this embodiment of the invention is formed in part by the corresponding end flaps 40, 42, 44, 46 on the dispensing end 47 of the carton 110. The dispenser 54 of this embodiment is substantially identical to the dispenser shown and described with respect to the first embodiment of the carton 10 and associated blank 12. Therefore, a detailed description of the dispenser 54 will not be repeated with respect to the carton 110 and associated blank 112 of FIGS. 4-6B.

The user may implement the gravity feed stand 174 to elevate or prop up the end 48 of the carton 110 opposite the dispensing end 47 and thereby providing a gravity feed inclination for the remaining cans in the carton 110 to roll towards the dispensing end 47 for convenient access and removal through the dispenser 57 by a user. Advantageously, the gravity feed stand 174 is initially erected by tearing the end 48 of the carton 110 in the top panel 16. As a result, the carton 110 with the dispenser 57 open may remain in an upright position while the stand 174 is erected thereby avoiding the problems of flipping the carton 110 to gain access to the feature on the bottom of the carton 110 used to elevate the carton 110 for gravity feed dispensing.

The gravity feed stand 174 of this embodiment includes a finger flap 176 located in the top panel 16 of the carton adjacent the end 48 opposite the dispensing end 47. The user inserts one or more fingers in the finger flap 76 and pulls toward the end 48 and away from the dispenser 57 thereby tearing the top panel 16 along a tear line 178 in opposite directions outwardly from the finger flap 176 toward the adjacent side panels 14, 18. The tear line 178 in the top panel 16 extends beyond the fold lines 22, 24 joining the side panels 14, 18 to the top panel 16. The tear line 178 is generally linear as it extends across the top panel 16. In the side panels 14, 18, the tear line 178 is angular and projects toward the junctures 134*a*, 138*d* between the side panels 14, 18 and the associated side end panels 134, 138. The tear line 178 then progresses in the side end panels 134, 138 in a generally L-shaped configuration until it terminates at a fold line 184 extending transversely across the side end panels, 134, 138. The fold line 184 is formed in the side end panels 134, 138 and is generally parallel to and spaced from a fold line 186 on the side end panels 134, 138 which originates at the bend in the L-shaped portion of the tear line 178. The fold lines 184, 186 separate the side end panels into upper 134*a*, 138*a* intermediate 134*b*, 138*b* and lower 134*c*, 138*c* regions of the end panel 48. The tear line 178 in the top panel 16 and portions of the side panels 14, 18 adjacent the end panel 48 defines a base 188 of the stand 174 that remains attached to the end panel 48 in a generally triangular shaped configuration of the gravity feed stand 174 as will be described later herein.

The configuration of the tear line 178 in the side end panels 134, 138 results in a pair of spaced shoulder panels 200, 200 in the end 48 of the carton 110 after the gravity feed stand 174 is erected. Each shoulder panel 200 is located adjacent one of the side panels 14, 18 on the end 48 of the carton 110 and combine to restrict the opening formed in the end 48 of the carton 110 from the gravity feed stand 174. The shoulder panels 200 and associated restricted opening in end 48 inhibit the escape or removal of the cans from the end 48 of the carton 110. As such, the cans are only able to exit the carton 110 via the dispenser 57 even when the gravity feed stand 174 is erected.

Figure 5B:
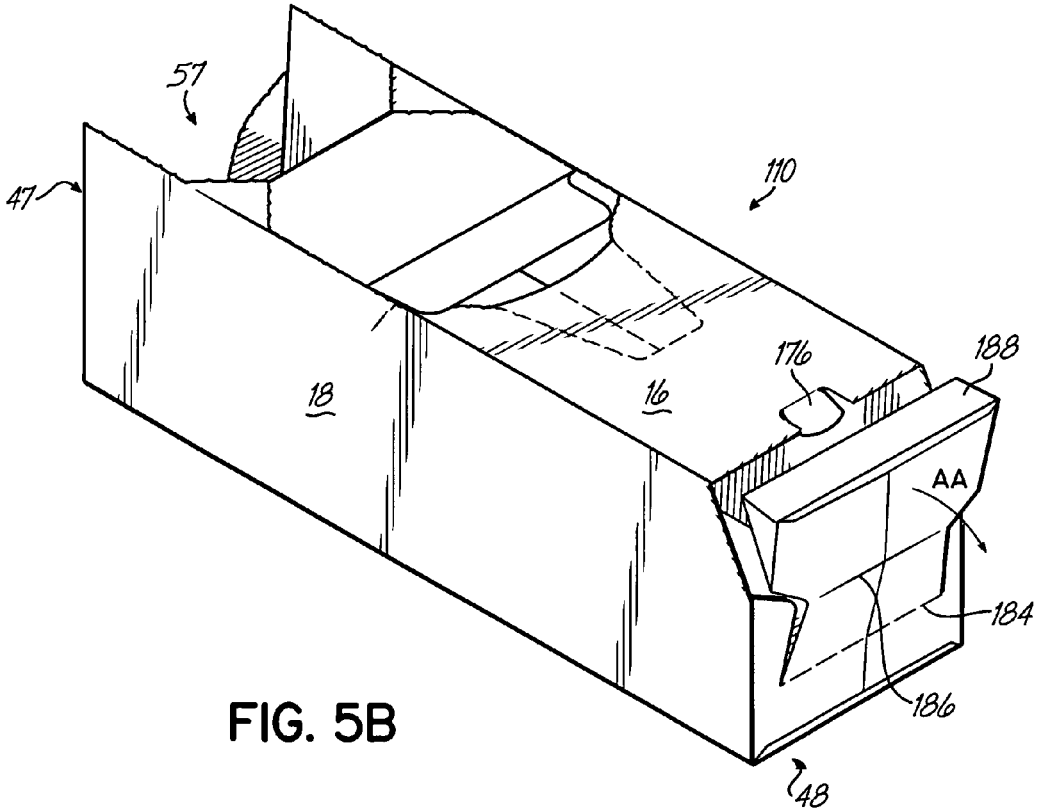
FIGS. 5B-5C are sequential views similar to FIG. 5A of the gravity feed stand being erected.
Figure 5C:
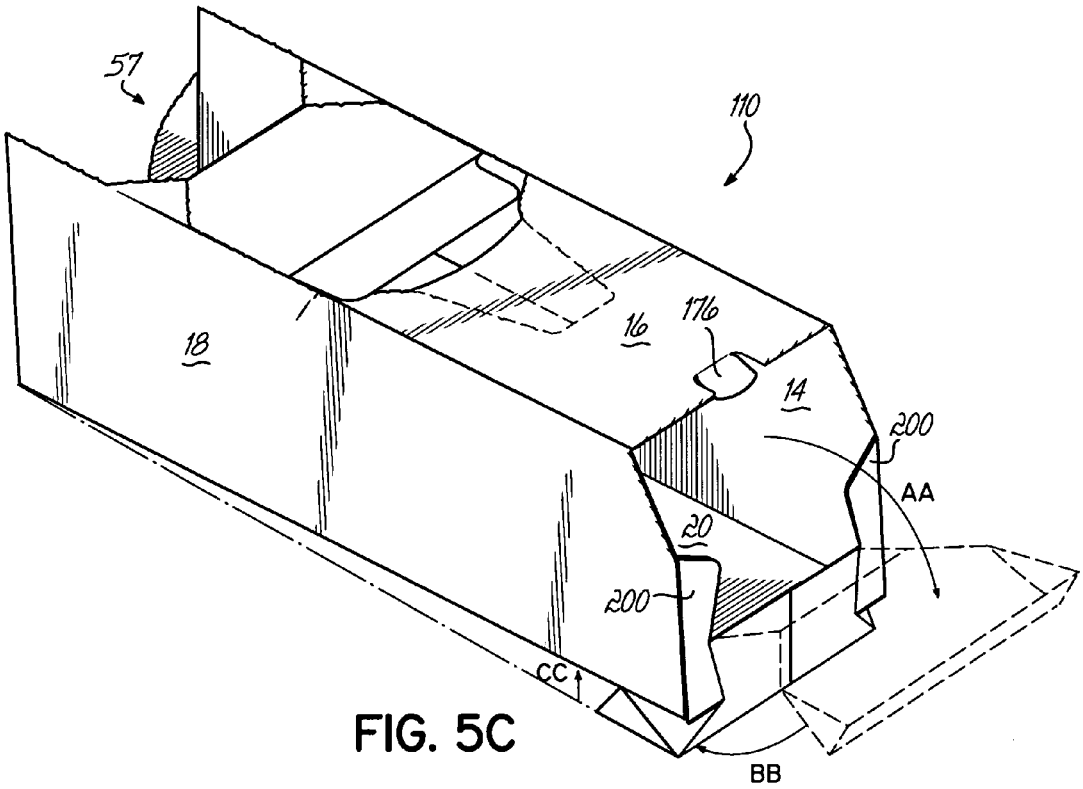
Figure 6A:
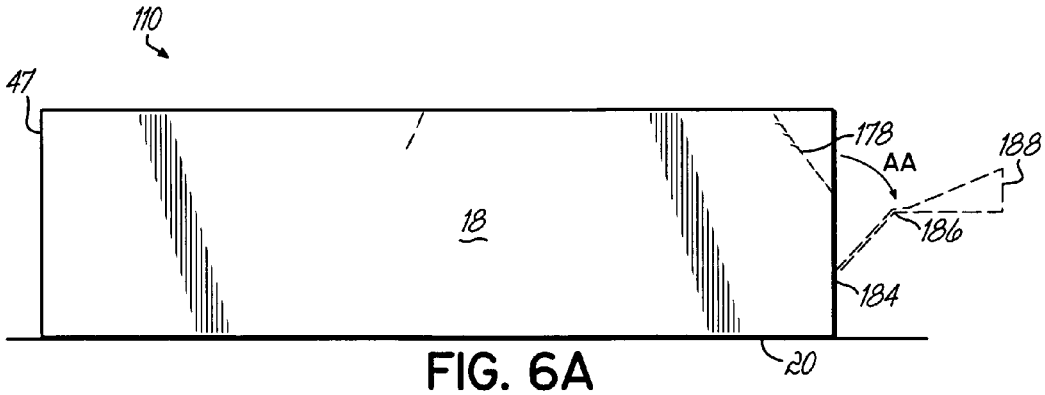
FIG. 6A is a side elevational view of the carton prior to and during the gravity feed stand being erected.
Figure 6B:
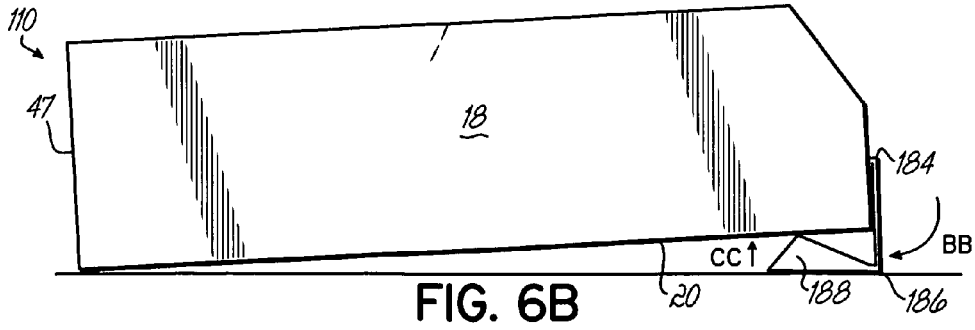
FIG. 6B is a side elevational view of an end of the carton being elevated with the gravity feed stand according to this embodiment of the invention.

As shown in FIG. 5B, the initial separation of the gravity feed stand 174 from the remainder of the carton 110 begins by tearing along the tear line 178 and pulling the base 188 and portions 134*a*, 138*a*, 138*b*, 134*b* outwardly from the carton 110 in the direction of arrow AA. The gravity feed stand 174 is then pivoted around the fold line 184 in the direction of arrow BB of FIG. 5C until the panels 134*b*, 138*b* are folded onto in face-to-face juxtaposition with the panels 134*c*, 138*c* as shown generally in FIG. 6B. At this point, the panels 134*a*, 138*a* and end portion of the top panel 16 form a triangular-shaped base 188 of the gravity feed stand 174 to prop up the end 48 of the carton 110 (arrow CC in FIG. 3B). The apex of the triangular-shaped base 188 contacts the bottom panel 20 to support the carton 110. In one embodiment, the portions 134*c*, 138*c* and 134*b*, 138*b* provide a retaining end wall 138*c*, 134C to prevent the cans from rolling out the end 48 of the carton 110 irrespective of the gravity feed inclination provided by the stand 174.

The various embodiments of this invention serve as useful dispensing cartons that can be placed in a gravity feed inclination upon a surface or within a compartment such as a refrigerator or pantry. Modifications may be made in the foregoing without departing from the scope and spirit of the claimed invention. It should be also appreciated that as used herein, directional references such as "top", "bottom", "end", "side", "upper" and "lower" do not limit the respective panels to such orientation, but merely serve to distinguish these panels from one another.

It should be further appreciated that any reference to hinged or foldable connection should not be construed as necessarily referring to a single fold line only. Hinged connections can be formed from one or more of one of the following: a score line, a frangible line, a cut crease line or a fold line, without departing from the scope of invention.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

What is claimed is:

1. A carton for containing a plurality of articles comprising:

a plurality of walls including a bottom wall spaced from a top wall, a pair of spaced side walls and a pair of spaced end walls, the side and end walls extending between the top and bottom walls;

a dispenser for removing articles from the carton, the dispenser being located proximate a first one of the end walls;

a handle opening in the top wall; and a gravity feed stand located opposite the first end wall and including a portion of a second end wall, the gravity feed stand being pivotally coupled to a remainder of the carton along at least one of the second end wall or the top wall and being free of all portions defining the bottom wall and the first end wall.

2. The carton of claim 1 wherein the gravity feed stand is juxtaposed to the bottom wall and includes portions of the top wall and each side wall.

3. The carton of claim 1 further comprising:

a finger flap for grasping the gravity feed stand, the finger flap being located in the top wall.

4. The carton of claim 1 further comprising:

a base as part of the gravity feed stand, the base being formed from portions of the top wall and each side wall.

5. The carton of claim 1 further comprising:

at least one retaining panel in the second end wall to retain the remaining articles in the carton.

6. The carton of claim 1 wherein the gravity feed stand remains attached to the carton.

7. The carton of claim 1 wherein the gravity feed stand further comprises:

at least one fold line in the second end wall.

8. The carton of claim 7 wherein portions of the second end wall adjacent to the at least one fold line are juxtaposed in face-to-face relation to each other.

9. The carton of claim 1, wherein the gravity feed stand has a generally triangular cross-sectional shape including a plurality of vertices, the gravity feed stand contacting the bottom wall along a single one of the vertices.

10. The carton of claim 1, further comprising:

an opening providing access into an interior of the carton, the opening being defined by deployment of the gravity feed stand into position.

11. The carton of claim 1, wherein the dispenser includes a first opening providing access to an interior of the carton, the carton further comprising:

a second opening at the second end wall providing access to the interior of the carton.

12. The carton of claim 1, wherein the gravity feed stand includes a planar bottom surface for contacting a support surface supporting the carton.

13. A carton for containing a plurality of articles comprising:

a plurality of walls including a bottom wall spaced from a top wall a pair of spaced side walls and a pair of spaced end walls the side and end walls extending between the top and bottom walls;

a dispenser for removing articles from the carton the dispenser being located proximate a first one of the end walls; and a gravity feed stand located opposite the first end wall and including a portion of a second end wall the gravity feed stand being pivotally coupled to a remainder of the carton along at least one of the second end wall or the top wall and being free of all portions defining the bottom wall and the first end wall;

wherein the gravity feed stand is partially separated from a remainder of the carton by a tear line.

14. The carton of claim 13 wherein the tear line extends across the top wall and into each side wall.

15. A carton for containing a plurality of articles comprising:

a plurality of walls including a bottom wall spaced from a top wall, a pair of spaced side walls and a pair of spaced end walls, the side and end walls extending between the top and bottom walls;

a dispenser for removing articles from the carton, the dispenser being located proximate a first one of the end walls;

a gravity feed stand located opposite the first end wall, being free of all portions defining the bottom wall and the first end wall, and including a portion of a second end wall and portions of the top wall and each side wall;

wherein the gravity feed stand is juxtaposed to the bottom wall and is partially separated from a remainder of the carton by a tear line and pivotally coupled to the remainder of the carton by a fold line along at least one of the second end wall or the top wall;

a finger flap for grasping the gravity feed stand, the finger flap being located in the top wall; and at least one retaining panel in the second end wall to retain the remaining articles in the carton when the gravity feed stand is juxtaposed to the bottom wall.

16. The carton of claim 15 wherein portions of the second end wall adjacent to the fold line are juxtaposed in face-to-face relation to each other.

17. A package comprising:

an article group formed of at least one tier of cylindrical articles disposed on sides thereof in a side-by-side parallel fashion; and a carton disposed around the articled group;

the carton comprising:

a plurality of walls including a bottom wall spaced from a top wall, a pair of spaced side walls and a pair of spaced end walls, the side and end walls extending between the top and bottom walls;

a dispenser for removing articles from the carton, the dispenser being located proximate a first one of the end walls; and a gravity feed stand located opposite the first end wall including a portion of a second end wall, the gravity feed stand being pivotally coupled to a remainder of the carton along at least one of the second end wall or the top wall and being free of all portions defining the bottom wall and the first end wall;

wherein the gravity feed stand is partially separated from a remainder of the carton by a tear line.

18. The package of claim 17 wherein the gravity feed stand includes portions of the top wall and each side wall.

19. The package of claim 17 further comprising:

a finger flap for grasping the gravity feed stand, the finger flap being located in the top wall.

20. The package of claim 17 further comprising:

a base as part of the gravity feed stand, the base being formed from portions of the top wall and each side wall.

21. The package of claim 17 further comprising:

at least one retaining panel in the second end wall to retain the remaining articles in the carton.

22. The package of claim 17 wherein the gravity feed stand remains attached to the carton.

23. The package of claim 17 further comprising two of the tiers of articles with each article in each tier being initially aligned with an article in the other tier.

24. The package of claim 17 wherein the gravity feed stand further comprises:

at least one fold line in the second end wall.

25. The package of claim 17 wherein portions of the second end wall adjacent to the at least one fold line are juxtaposed in face-to-face relation to each other.

26. A blank for forming a carton comprising:

a plurality of serially connected side wall, top wall and bottom wall panels adapted to form a pair of spaced side walls and a top wall and a bottom wall of the carton;

a plurality of side wall, top wall and bottom wall flaps each connected to ends of the respective side wall, top wall and bottom wall panels, the side wall, top wall and bottom wall flaps adapted to form end walls of the carton;

a plurality of tear lines adapted to form a dispenser opening in the carton through a first one of the end walls;

at least one tear line adapted to form a gravity feed stand in the carton, the gravity feed stand including at least a portion of a second end wall opposite from the dispenser and being free of all portions defining the bottom wall and the first end wall of the carton; and a fold line along one of the end wall opposite from the dispenser or the top wall panel for pivotally coupling the gravity feed stand to a remainder of the blank.

* * * * *

UNITED STATES PATENT AND TRADEMARK OFFICE

CERTIFICATE OF CORRECTION

PATENT NO. : 7,614,543 B1
APPLICATION NO. : 11/295267
DATED : November 10, 2009
INVENTOR(S) : Charles A. Miller It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 616 days.

Signed and Sealed this

Nineteenth Day of October, 2010

David J. Kappos

David J. Kappos
*Director of the United States Patent and Trademark Office*